US005544494A

United States Patent [19]

Manz et al.

[11] Patent Number: 5,544,494

[45] Date of Patent: Aug. 13, 1996

[54] METHOD AND APPARATUS FOR REFRIGERANT PURIFICATION

[75] Inventors: Kenneth W. Manz, Paulding; Daniel L. Olds, Bryan, both of Ohio

[73] Assignee: SPX Corporation, Muskegon, Mich.

[21] Appl. No.: 364,783

[22] Filed: Dec. 27, 1994

[51] Int. Cl.[6] ..... F25B 45/00

[52] U.S. Cl. ..... 62/292; 62/129; 62/475

[58] Field of Search ..... 62/77, 126, 129, 62/149, 157, 231, 292, 475

[56] References Cited

U.S. PATENT DOCUMENTS

| | | | |
|---|---|---|---|
| 3,873,289 | 3/1975 | White | 62/149 |
| 4,285,206 | 8/1981 | Koser | 62/126 |
| 4,476,688 | 10/1984 | Goddard | 62/149 |
| 4,953,357 | 9/1990 | Van Steenburgh | 62/45.1 |
| 5,005,369 | 4/1991 | Manz | 62/195 |
| 5,033,271 | 7/1991 | Manz et al. | 62/125 |
| 5,063,749 | 11/1991 | Manz | 62/149 |
| 5,181,388 | 1/1993 | Abraham | 62/77 |
| 5,187,940 | 2/1993 | Paxton | 62/77 |
| 5,211,024 | 5/1993 | Manz et al. | 62/126 |
| 5,240,483 | 8/1993 | Rosen | 55/270 |
| 5,247,803 | 9/1993 | Adams et al. | 62/77 |
| 5,357,678 | 10/1994 | Van Steenburgh, Jr. | 62/292 |
| 5,361,594 | 11/1994 | Young | 62/129 |

OTHER PUBLICATIONS

Industry Recycling Guideline (IRG–1), "Handling & Reuse of Refrigerants in the U.S.," Air–Conditioning and Refrigeration Institute (Jun. 1994).

*Primary Examiner*—Henry A. Bennett
*Assistant Examiner*—William C. Doerrler
*Attorney, Agent, or Firm*—Barnes, Kisselle, Raisch, Choate, Whittemore & Hulbert

[57] ABSTRACT

Refrigerant is purified by circulating the refrigerant in a closed path from a first refrigerant container through a filter/dryer unit back to the first refrigerant container. Air and other non-condensibles are purged from the refrigerant in the first storage container during this refrigerant circulation process. Following the non-condensible purging operation, the refrigerant in the first container is transferred through a filter/dryer unit into a second refrigerant container. This second refrigerant container is evacuated prior to transferring the purified refrigerant thereto. Capacity of the filter/dryer unit is monitored, either by monitoring time of operation of the refrigerant pump or monitoring wetness of the circulated refrigerant with the sight gauge.

19 Claims, 2 Drawing Sheets

METHOD AND APPARATUS FOR REFRIGERANT PURIFICATION

The present invention is directed to refrigerant purification, and more particularly to a method and apparatus for purifying refrigerant within a refillable refrigerant storage container.

BACKGROUND AND OBJECTS OF THE INVENTION

U.S. Pat. No. 5,033,271, assigned to the assignee hereof, discloses an apparatus for purification of refrigerant that includes a liquid refrigerant pump and hoses for selectively connecting the pump through a filter/dryer unit to the liquid and vapor ports of a refrigerant storage container. The pump circulates liquid refrigerant in a closed path from the liquid port of the storage container through the filter/dryer unit for removing water and other contaminates from the refrigerant, and then back to the vapor port of the refrigerant storage container. Operative condition of the filter/dryer unit is indicated by a differential pressure gauge connected across the filter dryer unit, and by a moisture indicator connected in series with the filter/dryer unit in the closed liquid refrigerant flow path. In the commercial embodiment of this device marketed by applicant's assignee, the device also includes a gauge as shown in U.S. Pat. No. 5,063,749, also assigned to the assignee hereof, for indicating pressure of air and other non-condensibles within the refrigerant storage container, and a manual valve for purging such non-condensibles from the purge port of the container.

Although the refrigerant purification apparatus so described has enjoyed commercial acceptance and success, further improvements are desirable. In particular, the sight glass moisture indicator employed in this apparatus, having an indication capability of 50 ppm for R-22 refrigerant and 80 ppm for R-134a refrigerant, cannot alone assure that the purified refrigerant meets current industry standards and guidelines in the range of 10 to 20 ppm. Consequently, there is a need for a compact, inexpensive and simple refrigerant purification apparatus and method of the type disclosed in the above-noted patents, but having improved capability for assuring that the purified refrigerant meets industry standards and guidelines. It is a general object of the present invention to provide such an apparatus and method. Another object of the present invention is to provide a method of employing the above-described device marketed by applicant's assignee and already in the field in such a way as to assure that purified refrigerant meets or exceeds current industry standards and guidelines.

SUMMARY OF THE INVENTION

Refrigerant is purified in accordance with the present invention by circulating the refrigerant in a closed path from a first refrigerant container through a filter/dryer unit back to the first refrigerant container. Air and other non-condensibles are purged from the refrigerant in the first container during this refrigerant circulation process. Following this non-condensible purging operation, the refrigerant in the first container is transferred through a filter/dryer unit into a second refrigerant container. In the preferred implementation of the invention, this second refrigerant container is evacuated prior to transferring the purified refrigerant thereto. Capacity of the filter/dryer unit is monitored, either by monitoring time of operation of the refrigerant pump or monitoring wetness of the circulated refrigerant with the sight gauge.

In one embodiment of the invention that is particularly useful for retrofitting existing purification units as described above, a meter is coupled to the liquid refrigerant pump for monitoring time of operation of the pump, and thereby indicating remaining capacity of the filter/dryer unit. The combination of the meter and the known capacity of the filter/dryer unit allows the apparatus to assure a purity of less than 20 ppm, even though the moisture indicator is only reliable to 50 ppm. The refrigerant hose that connects the pump outlet to the storage container vapor port during the circulation/purification mode of operation may be selectively removed from such port and connected to the vapor port of an evacuated second refrigerant container for transfer of refrigerant thereto. In a second embodiment of the invention, a three-way valve selectively connects the outlet of the liquid refrigerant pump to the vapor port of the first refrigerant container through a first filter/dryer unit, and to the second container through a second filter/dryer unit for implementing the refrigerant transfer mode of operation. The vapor ports of the two containers may be interconnected during the final transfer stage to equalize pressure between the two containers and improve transfer performance. In both embodiments, non-condensibles are purged from the purge port of the first refrigerant container during the circulation/purification mode of operation.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENTS

Figure 1:
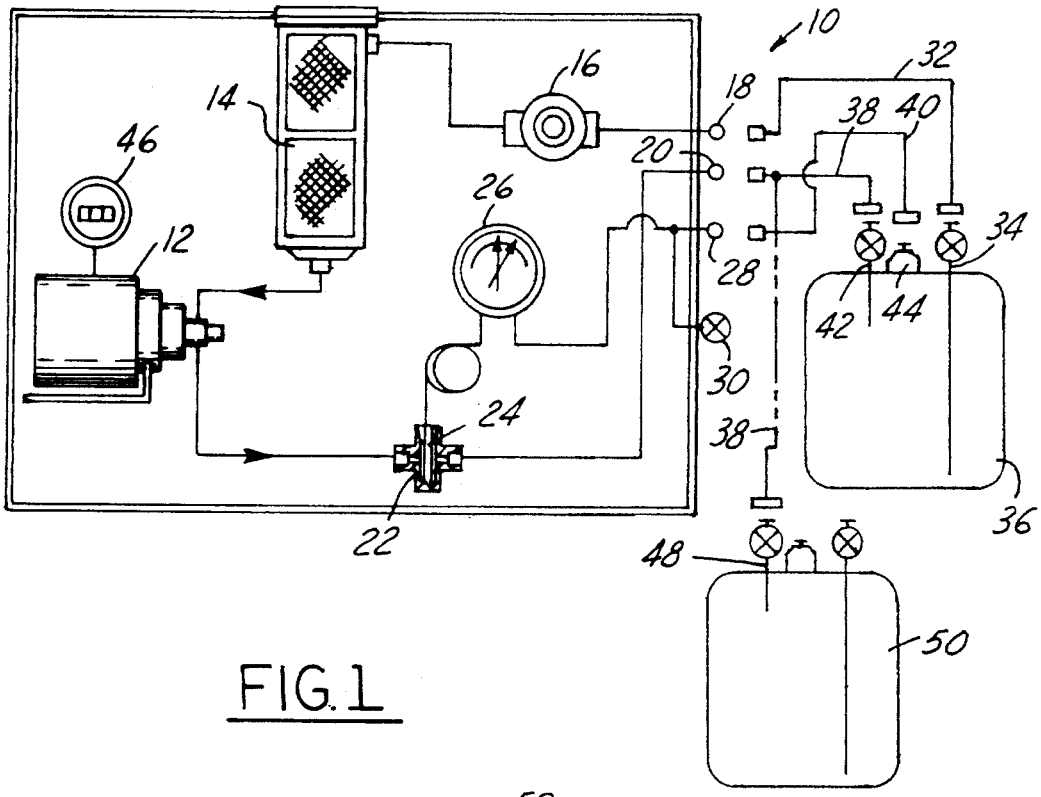
FIG. 1 is a schematic diagram of a refrigerant purification apparatus in accordance with a first embodiment of the present invention.

FIG. 1 illustrates a refrigerant purification apparatus 10 in accordance with one presently preferred embodiment of the invention as comprising a liquid refrigerant pump 12 having an inlet connected to an inlet port 18 through a filter/dryer unit 14 and a moisture-indicating sight glass 16. The outlet of pump 12 is connected to an outlet port 20 through a fitting 22 that contains a refrigerant bulb 24. A double-needle gauge 26 has one inlet connected to refrigerant bulb 24, and a second inlet connected to a purge port 28 and a manual purge valve 30. A first refrigerant hose or conduit 32 selectively connects inlet port 18 to the valved liquid port 34 of a refillable refrigerant storage container 36. A second refrigerant hose 38 connects outlet port 20 to the valved vapor port 42 of container 36, and a third hose 40 connects port 28 to purge port 44 of container 36.

To the extent thus far described, apparatus 10 is similar to that disclosed in above-noted U.S. Pat. No. 5,063,749. With hoses 32,38,40 connected as described, pump 12 is operated to circulate liquid refrigerant in a closed path from port 34 of container 36, through sight glass 16 and filter/dryer unit 14 for removing water and other impurities from the refrigerant, and through air purge fitting 22 back to vapor port 42 of container 36. Gauge 26 indicates a pressure differential between the vapor pressure of refrigerant within bulb 24 at the temperature of refrigerant circulating from and to the storage container, and pressure of refrigerant vapor and non-condensibles within container 36 over the liquid refrigerant. When such pressure differential exceeds the desired limit, valve 30 is manually opened to purge air and other non-condensibles from within the storage container through purge port 44.

In accordance with the present invention, an hour meter or other time-measuring device 46 is operatively coupled to pump 12 in such a way as to monitor and indicate time of operation of the pump. That is, given a known water adsorption capacity of filter/dryer 14, and assuming maximum refrigerant wetness conditions, a desired time of operation may be assigned to filter/dryer 14 for each type of refrigerant in connection with which apparatus 10 will be employed. When meter 46 indicates that pump 12 has been operated for this time duration, the core of filter/dryer 14 may be replaced, meter 46 may be reset, and operation continued for purification of refrigerant. Pump 12 is initially operated, for eighteen minutes for example, before air purging is initiated. Then, valve 30 is opened and purging is initiated if meter 26 so indicates. When meter 26 indicates that purging of non-condensibles has been completed, hose 38 is disconnected from port 42 of container 36, and is connected to vapor port 48 of a second refrigerant storage container 50 that has previously been evacuated. Continued operation of pump 12 then transfers refrigerant from liquid port 34 of container 36 through filter/dryer 14 to vapor port 48 of container 50. The combination of meter 46 (indicating remaining filter capacity) and the known capability of filter/dryer 14 permits assurance that refrigerant water content will be less than 20 ppm in container 50, even though indicator 16 is only reliable to 50 ppm.

Figure 2:
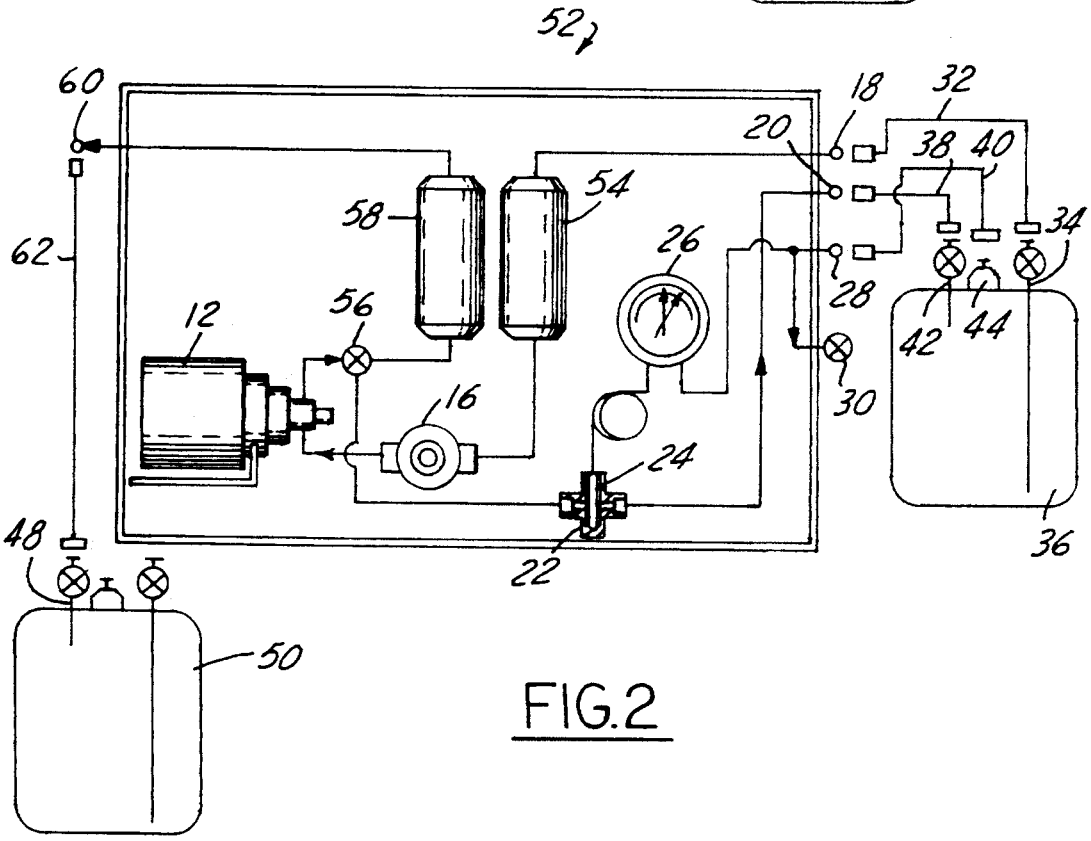
FIG. 2 is a schematic diagram of a refrigerant purification apparatus in accordance with a second embodiment of the invention.

FIG. 2 illustrates a modified embodiment 52 of the present invention, in which reference numerals identical to those employed in FIG. 1 indicate identical elements. Liquid refrigerant pump 12 has an inlet connected to inlet port 18 through sight glass 16 and a first filter/dryer unit 54. The outlet of pump 12 is connected to a three-way valve 56. In a first position of valve 56, the outlet of pump 12 is connected through air purge fitting 22 to outlet port 20 as in the embodiment of FIG. 1. In a second position of valve 56, the outlet of pump 12 is connected through a second filter/dryer unit 58 to a refrigerant transfer outlet port 60, and thence by a refrigerant hose 62 to the vapor port 48 of second refrigerant storage container 50. Filter/dryer units 54, 58 preferably are of conventional loose-fill desiccant type. It is to be noted, in this connection, that only purified refrigerant is fed through filter/dryer unit 58. So long as the refrigerant exiting filter 54 shows dry at sight glass 16, the refrigerant exiting filter 58 to storage container 50 will meet the industry standards of 20 ppm water content. When sight glass 16 indicates failure of filter/dryer 54 to remove water from refrigerant during the circulation and purification mode of operation, the desiccant in both filters 54, 58 may be changed.

In a single pass through a filter/dryer, the filter dryer will remove a known amount of water that varies with the end point dryness and the refrigerant flow parameters. When less than that amount of water has been removed, the actual end point dryness will be less than the rated end point dryness. A combination of experimentation and saturated moisture calculations reveals pounds of refrigerant at saturated conditions that the filter/dryer holds while still producing refrigerant within the end point dryness specifications. Referring to FIG. 1, this translates to spec dryness between filter/dryer 14 and port 42. When this spec dry refrigerant mixes with wet refrigerant within tank 36, the dry refrigerant picks up moisture to an unknown level between spec dry and saturated. When the mixed refrigerant passes moisture indicating sight glass 16, an indication is obtained when the refrigerant inside the tank and up to the inlet of the filter/dryer is less than 50 ppm for R-22, but higher than 20 ppm. In the final transfer to port 48 of second tank 50, the spec dry refrigerant is not remixed with wet refrigerant. In FIG. 1, the filter/dryer will spec dry refrigerant from 50 ppm (R-22) down to less than 20 ppm if the filter/dryer water capacity, as monitored by the hour meter, has not been exceeded. In FIG. 2, second filter/dryer 58 will spec dry refrigerant from 50 ppm (R-22) down to less than 20 ppm if first filter/dryer 54 will dry to 50 ppm (R-22) on indicator 16 (a comparative measurement between filter/dryer 58 and filter/dryer 54 capacity).

Figure 3:
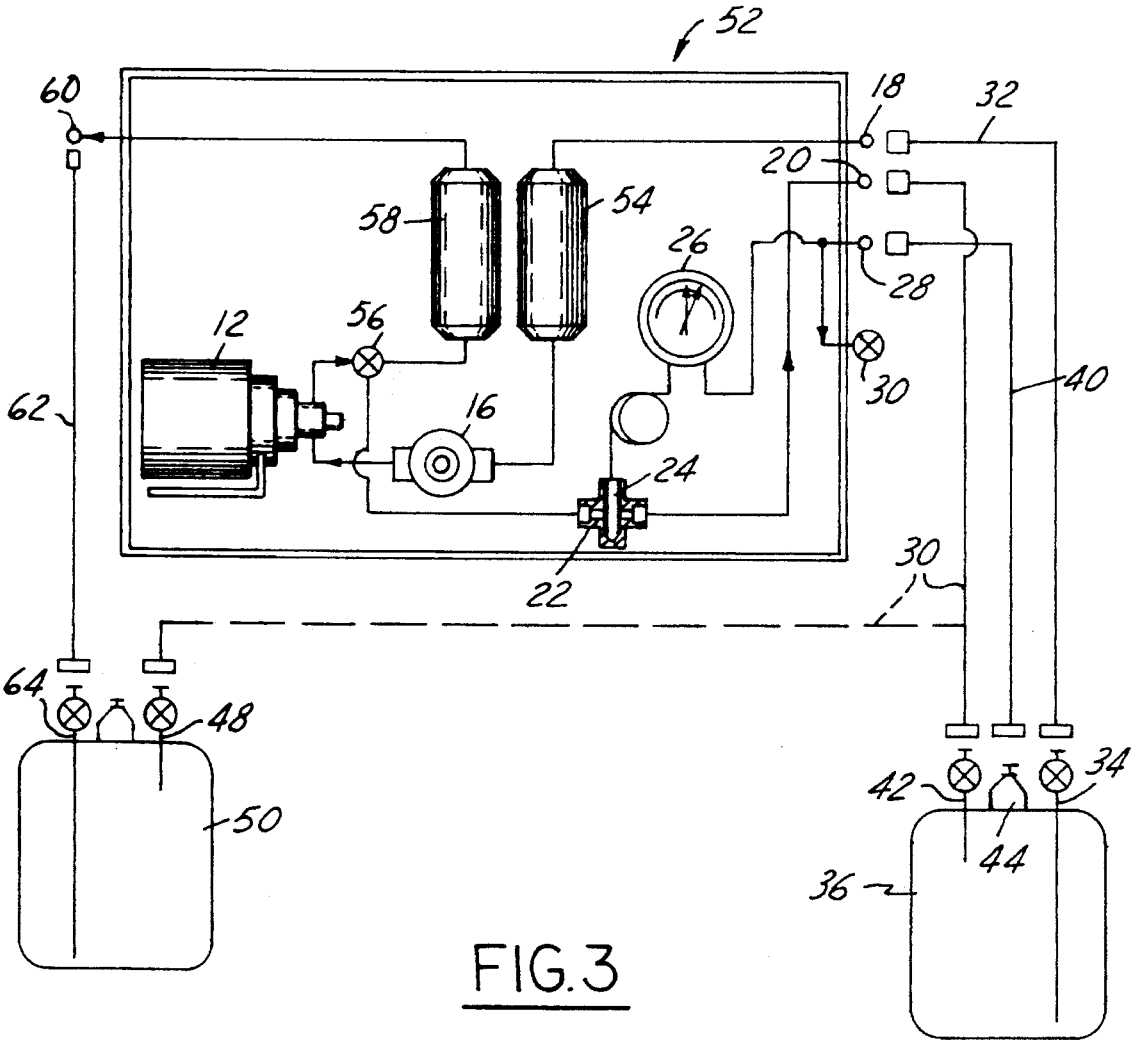
FIG. 3 is a schematic diagram of a modification to the embodiment of FIG. 2.

FIG. 3 illustrates a modification to the container connection arrangement of FIG. 2 during the final transfer stage. Hose 62 in FIG. 3 is connected to the liquid port 64 of container 50, and hose 38 interconnects vapor ports 42,48 of containers 36,50. Thus, during the final transfer stage as refrigerant is pumped into container 50, hose 38 cooperates with vapor ports 42,48 to equalize pressure between containers 36,50 and improve pump performance.

The invention has been described in conjunction refillable-type refrigerant storage container 36,50, but is by no means limited thereto. Other refrigerant containment means may be employed. Indeed, second containment means 50 may comprise a refrigeration system, such as an air conditioning system, that is recharged by refrigerant following drying and purification of the refrigerant. Although the method and apparatus of the invention are disclosed in conjunction with refrigerant recycling, which is the preferred implementation, it will be recognized that the apparatus may be employed for recovering refrigerant to container 36 on a first pass through the filter/dryer, and thereafter for recycling as described. During recovery and/or recycling, additional equipment may be employed, such as oil separation equipment to separate oil to industry standard specifications. Liquid refrigerant pump 12 may be replaced by other refrigerant pumping means, such as a compressor.

We claim:

1. A method of purifying refrigerant comprising the steps of:

(a) circulating the refrigerant in a closed path from first refrigerant containment means through filter/dryer means back to said first containment means, (b) purging non-condensibles from the refrigerant in said first containment means during operation of said step (a), and (c) following completion of said step (b) when non-condensibles have been purged from the refrigerant in said first containment means, transferring the refrigerant from said first containment means through filter/dryer means into second refrigerant containment means.

2. The method set forth in claim 1 comprising the additional step, prior to said step (c), of: (d) evacuating said second refrigerant containment means.

3. The method set forth in claim 1 wherein said filter/dryer means employed in said step (c) is separate from said filter/dryer means employed in said step (a).

4. The method set forth in claim 1 wherein said filter/dryer means employed in said step (c) is the same as said filter/dryer means employed in said step (a).

5. The method set forth in claim 1 wherein said step (a) is accomplished by operating a liquid refrigerant pump to pump the refrigerant in liquid phase through said closed path from and to said first refrigerant containment means.

6. The method set forth in claim 5 comprising the additional step of: (d) monitoring operating condition of filter/dryer means.

7. The method set forth in claim 6 wherein said step (d) is accomplished by monitoring time of operation of said pump.

8. The method set forth in claim 6 wherein said step (d) is accomplished by monitoring moisture content of refrigerant circulated through said filter/dryer means.

9. The method set forth in claim 1 wherein said step (b) is accomplished by manually opening a purge port on said first refrigerant containment means.

10. Apparatus for purifying refrigerant within first refrigerant containment means comprising:

filter/dryer means for removing water from refrigerant passing therethrough, refrigerant pump means, means for removably connecting said filter/dryer means and said refrigerant pump means to said first refrigerant containment means for circulating refrigerant in a closed path from said first refrigerant containment means through said filter/dryer means and said pump means back to said first refrigerant containment means, means for purging non-condensibles from refrigerant in said first refrigerant containment means, and means for selectively connecting said refrigerant pump means through said filter/dryer means to second refrigerant containment means separate from said first refrigerant containment means to transfer purified refrigerant from said first refrigerant containment means to said second refrigerant containment means through said filter/dryer means.

11. The apparatus set forth in claim 10 wherein said means for selectively connecting said refrigerant pump means through said filter/dryer means to said second refrigerant containment means comprises a three-way valve having a first position for connecting said pump means in said closed path and a second position for connecting said pump means to said second refrigerant containment means.

12. The apparatus set forth in claim 11 wherein said filter/dryer means comprises first filter/dryer means disposed in said closed path and second filter/dryer means disposed between said valve means and said second refrigerant containment means.

13. The apparatus set forth in claim 10 further comprising means for interconnecting vapor ports of said first and second refrigerant containment means during transfer of refrigerant from said first to said second containment means.

14. The apparatus set forth in claim 10 wherein said first and second containment means respectively comprise first and second refillable refrigerant storage containers each having a liquid port, a vapor port and a purge port.

15. The apparatus set forth in claim 14 wherein said selectively connecting means comprises means for connecting said refrigerant pump means to pump refrigerant from the liquid port of said first container to the liquid port of the second container, and means for interconnecting said vapor ports of said first and second containers to equalize pressure therebetween.

16. A method of removing water from refrigerant in first refrigerant containment means to a predetermined dryness specification employing dryness indicating means capable of indicating dryness to a level less than said predetermined specification, said method comprising the steps of:

(a) circulating the refrigerant in a closed path from said first containment means through filter/dryer means for removing water from the refrigerant back to said first refrigerant containment means, (b) during said step (a), monitoring dryness of the refrigerant circulating in said closed path using said dryness indicating means, and (c) when dryness indicated by said dryness indicating means in said step (b) reaches said level, transferring the refrigerant in said first containment means through said filter/dryer means to second refrigerant containment means.

17. The method set forth in claim 16 comprising the additional step, prior to said step (c), of: (d) evacuating said second refrigerant containment means.

18. The method set forth in claim 16 wherein said first and second containment means respectively comprise first and second refillable refrigerant storage containers, each having a liquid port, a vapor port and a purge port.

19. The method set forth in claim 18 wherein said step (c) comprises the steps of: (c1) interconnecting the vapor ports on said first and second storage containers to equalize pressure between said containers, and (c2) transferring refrigerant from the liquid port of said first container to the liquid port of said second container.

* * * * *